US011585059B1

(12) United States Patent
Smith

(10) Patent No.: US 11,585,059 B1
(45) Date of Patent: Feb. 21, 2023

(54) ARTICULATED BLOCK MAT FOR USE WITH HARBOR PIERS AND METHOD OF INSTALLING A PIER MAT

(71) Applicant: Lee A. Smith, Houston, TX (US)

(72) Inventor: Lee A. Smith, Houston, TX (US)

( * ) Notice: Subject to any disclaimer, the term of this patent is extended or adjusted under 35 U.S.C. 154(b) by 0 days.

(21) Appl. No.: 17/317,155

(22) Filed: May 11, 2021

Related U.S. Application Data

(60) Provisional application No. 63/026,659, filed on May 18, 2020.

(51) Int. Cl.
*E02B 3/12* (2006.01)

(52) U.S. Cl.
CPC ..... *E02B 3/122* (2013.01)

(58) Field of Classification Search
CPC ..... E02B 3/122; E02B 3/123; E02B 3/12
USPC ..... 405/16, 19, 20
See application file for complete search history.

(56) References Cited

U.S. PATENT DOCUMENTS

| | | | | |
|---|---|---|---|---|
| 4,227,829 | A | 10/1980 | Landry, Jr. | |
| 4,370,075 | A | 1/1983 | Scales | |
| 4,375,928 | A | 3/1983 | Crow et al. | |
| 5,087,150 | A | 2/1992 | McCreary | |
| 5,160,215 | A | 11/1992 | Jensen | |
| 5,484,230 | A | 1/1996 | Rudloff | |
| 5,697,736 | A | 12/1997 | Veazey et al. | |
| 5,921,710 | A * | 7/1999 | Scales | E02B 3/14 405/20 |
| 6,293,730 | B1 | 9/2001 | Lee | |
| 6,406,217 | B1 | 6/2002 | Daniel et al. | |
| 6,508,607 | B1 | 1/2003 | Smith et al. | |
| 7,806,038 | B2 * | 10/2010 | Duke | F41H 5/04 89/36.01 |
| 8,678,705 | B1 | 3/2014 | Smith et al. | |
| 8,950,974 | B2 | 2/2015 | Thompson et al. | |
| 9,920,500 | B2 | 3/2018 | Thompson et al. | |
| 9,926,680 | B2 | 3/2018 | Boasso | |
| 10,301,788 | B2 | 5/2019 | Benton, Jr. | |
| 2001/0051249 | A1 * | 12/2001 | Gagas | E02B 3/068 428/45 |
| 2004/0265060 | A1 * | 12/2004 | Lee | E01D 19/02 405/16 |

* cited by examiner

*Primary Examiner* — Sean D Andrish
(74) *Attorney, Agent, or Firm* — Roger N. Chauza, PC

(57) ABSTRACT

A pier mat of erosion control blocks for abating erosion around piers of a wharf. A mat of blocks is arranged so as to have a linear end edge and a vacant space formed in an opposite end edge thereof, where the vacant space is for surrounding at least a part of a pier. A linear end edge of another similar pier mat is installed so as to abut the end edge of the first mat having the vacant space, thereby fully surrounding the pier. A method of installing a pier mat of erosion control blocks is also disclosed.

19 Claims, 13 Drawing Sheets

ARTICULATED BLOCK MAT FOR USE WITH HARBOR PIERS AND METHOD OF INSTALLING A PIER MAT

RELATED APPLICATION

This U.S. non-provisional patent application claims the benefit of U.S. provisional application Ser. No. 63/026,659, filed May 18, 2020.

TECHNICAL FIELD OF THE INVENTION

The present invention relates in general to articulated revetment block mats for controlling erosion, and more particularly to a mat of erosion control blocks for use around wharf piers used in harbors.

BACKGROUND OF THE INVENTION

Articulated Concrete Mats (ACM) of erosion control blocks have been utilized since the early 1960's in the United States to prevent the erosion of soil. The mats are fabricated using a number of erosion control blocks cabled or otherwise fastened together. These mats were/still are referred to as pre-assembled mats with cables that allow for lifting and placement of the mats using a spreader bar hoisted by a crane or other heavy equipment, such as a hydraulic excavator. The size of mats range generally up to 8 feet in width and up to 40 feet in length, i.e., the maximum size for semi-tractor/trailers in order to haul the mats to the construction job sites. It is also common to have different widths and lengths of mats to accommodate on-site installation of projects requiring different mat sizes, for example 8'×16' mats, 8'×24' mats, or 8'×40' mats, and 6'×30' mats.

FIG. 1 is an example of a common pre-assembled mat 10 that has been available for over 60 years. The mat 10 includes a number of blocks 12 cabled together, and lifted with a steel spreader bar 14 for loading onto trucks to be delivered to job sites. The spreader bar 14 is generally rectangular and lifted at its four corners by cables, one shown as numeral 16. Two or more guide cables 22 and 24 can be employed for workmen to guide the suspended mat 10 onto the desired location, such as stacked on top of another mat previously loaded on a trailer bed. The mat 10 of blocks 12 is suspended from the opposite ends of the spreader bar 14 with cables 18. In the illustration, there is one chain 18 for each column of blocks in the mat 10. The mat 10 shown in FIG. 1 is 4'×31'. Several previous ACM configurations for mat systems are illustrated in U.S. Patents, and include U.S. Pat. Nos. 8,678,705; 4,227,829; 4,370,075 and 5,484,230. One can see that all previous ACM teaches one skilled in the art to lift corresponding mats with equal widths on both ends of mats. These types of ACM are all the same with respect to the width of the mats on both longitudinal ends of all mats when being lifted, for example, 8-foot widths. The cables that hold the blocks of a mat 10 together extend from the ends of the mat 10 and form loops 20. The loops 20 function as "lifting hooks" for a spreader bar 14 using chains 18 to lift the mats 10. Other individual lateral cables are threaded through the blocks 12 to hold the blocks together.

The blocks 12 of the mat 10 of FIG. 1 are each cabled together with synthetic ropes or cables to hold the individual blocks together as a mat or unit, as well as to be lifted by the spreader bar 14 to move the mat 10 from either the shore or a truck bed to an underwater location. The spreader bar 14 is connected to the looped synthetic cables 20 that extend beyond the opposite ends of the mat 10, and the mat 10 is then lifted. The mat 10 that is suspended at the ends by the spreader bar 14 becomes arc-shaped, with the middle of the mat 10 bowed down in the middle, also as shown in FIG. 1. When lowered into position onto the ground at the water-covered surface, the looped cables 20 at each end of the mat 10, and the individual cable pigtails at each side of the mat 10 can be connected by divers to the corresponding cables of adjacent mats. Any number of mats can be installed in the underwater location so as to cover a level or contoured area. As can be appreciated, when the underwater location is populated with one or more vertical protrusions, such as piers, then a mat 10 of blocks shown in FIG. 1 is not easily employed. One reason is that the spreader bar 14 is linear at each end and would thus engage the pier and prevent the mat from being laid on at least three sides of the pier.

As noted above, the erosion of banks and other similar sloped locations can be prevented by either installing individual interlocking erosion control blocks on such banks, or by installing large mats of cabled erosion control blocks using a crane. The erosion control blocks can be individually installed by workmen, which is labor intensive, or the blocks can be cabled together (as described above) into a mat and installed using a crane or the like. Either technique is adequate to cover the ground area with erosion control blocks and prevent erosion of the earth material during heavy rains, flooding or turbulent water caused by ships and the associated propulsion systems. Large mats of erosion control blocks have been installed in waterways and at ocean shores and the like. In these situations, the erosion control blocks are arranged in a mat and cabled together and then lifted by a crane and lowered into the water and onto the underlying ground to protect the same from erosion. Often the erosion control blocks are interlocking, and thus divers are required to guide the edges of a new mat into an interlocking relationship with the interlocking edges of the previously laid mat. If an occasional vertical obstacle is encountered in the installation of the underwater mats, then the mats are attempted to be laid around the obstacle, and the uncovered area around the obstacle is grouted to protect such area from erosion. The grouting of the uncovered area requires additional material and labor efforts and is thus costly and time consuming.

There is a need for a specialized pre-assembled ACM with a U-shaped void formed into one edge thereof. Such a mat can be installed around three sides of a concrete pier, such as used to construct bridges, barge terminals, and wharf expansions. Barge terminals and wharf expansions commonly install pre-assembled ACMs under water on steep slopes to protect the slopes from erosion caused by large barge vessels that come into dock at port harbor authorities, chemical plants, and wharf terminals. Many large barge vessels have side jet thrusters that create substantial underwater turbulence, thus causing severe erosion of the underwater slopes and embankments that are intended to protect the terminals and wharfs.

Terminals and wharf expansions have concrete piers placed all along and in the slopes at underwater locations, many of which are 25-40 feet deep. These piers function as the bracing members to support the terminal platforms above ground where barges and other vessels dock. The ACM are placed on the slopes and must also be placed around these piers for erosion control protection. It is quite common to construct the concrete piers first, then to place the ACM around the piers for the erosion protection.

While the foregoing techniques function well for installing mats of erosion control blocks on flat or contoured areas, a problem exists when the mats of erosion control blocks are to be installed around the many piers supporting wharfs and bridge piers, and other similar situations. A further need exists for installing mats of erosion control blocks around vertical protrusions from the ground, such as trees and poles, and on ground areas not covered with water. A need exists for a new type of mat of erosion control blocks that can be installed on the ground, or underwater around the wharf piers, without the needless use of grouting large and uncovered areas immediately adjacent to the piers or tree. A further need exists for both a mat and a spreader bar that can efficiently install the mat around at least a portion of a pier.

SUMMARY OF THE INVENTION

In accordance with the principles and concepts of the invention, disclosed is a mat of erosion control blocks that has a vacant space or void formed in an edge thereof for surrounding a portion of a pier. An edge of a second mat is then placed against the pier to close the vacant space of the first mat, thereby encircling the pier.

According to a feature of the invention, a matrix of rows and columns of blocks form a mat that is cabled together. An edge of the mat lacks a number of blocks that form the vacant space of a size to accommodate at least a portion of a vertical obstruction, such as a pier. The vacant space is bounded by one or more base blocks that form one side of the vacant space. The vacant space is bounded by two other sides that include two legs, each of which includes one or more blocks.

The cables by which the pier mat is held together extend from the two legs and are looped to form lifting points for that edge of the pier mat. The opposite side of the pier mat can be a linear edge where the cables that extend from each block are looped to form lifting points for the opposite edge of the pier mat. A spreader bar of similar shape, namely one with a vacant space, can be employed to lift the pier mat so that both of the vacant spaces can accommodate the vertical pier when installing the pier mat around the pier.

With regard to a further feature of the invention, the pier mats can be of sufficient length such that the downslope edge with the vacant space is installed around the downslope pier, and the upslope linear edge of the mat can be laid so as to abut the upslope pier. When this is repeated for the other piers in a row, the piers are each surrounded by the blocks of the two mats and less grouting is required. When needed, other conventional rectangular mats of blocks can be installed laterally between the rows of piers.

An advantage of the pier mat of the invention, is that no special erosion control blocks are necessary. Rather, many conventionally available blocks can be employed for cabling into a pier mat of the invention. The columns of blocks in a mat can be linear columns, or the blocks in a column can be staggered in a zig zag fashion. The cabling of the different types of columns of blocks can be accomplished to hold the mat together.

According to another feature of the invention, the pier mat can have a vacant space at opposite ends of the mat, thus accommodating two piers at each end of the mat. Further, the pier mat can be made of two parts, each of which has a partial vacant space, and when the two mat parts are brought together the pier is again enclosed on three sides thereof.

According to an embodiment of the invention, disclosed is a mat of erosion control blocks that includes a plurality of blocks arranged in a matrix to form the mat. A vacant space is defined by an absence of one or more blocks, the blocks of the mat arranged to provide the vacant space. And, the vacant space is for receiving therein at least a portion of a vertical object.

According to another embodiment of the invention, disclosed is a mat of erosion control blocks that includes a plurality of blocks arranged in a matrix to form the mat, where the matrix of blocks includes columns of blocks and rows of blocks. At least one column of x number of blocks is located on the left side of the mat, and at least one column of x number of blocks is located on the right side of the mat. There is at least one middle column of blocks having y number of blocks, where y is less than x. As such, the middle column has fewer blocks than the column of blocks on the left side of the mat, and the middle column has fewer blocks than the column of blocks on the right side of the mat. A vacant space is defined by an absence of one or more blocks in the middle column, and the vacant space is formed inwardly from an edge of the mat. The vacant space is for receiving therein at least a portion of a vertical object.

According to an additional embodiment of the invention, disclosed is a method of installing a pier mat of erosion control blocks. The method includes lifting a pier mat of erosion control blocks at each end of two opposing ends of the pier mat so that the pier mat bows downwardly between the opposing ends. One end of the opposing ends has a vacant space formed inwardly from the one end. The method further includes moving the bowed pier mat of erosion control blocks adjacent a pier so that the vacant space of the bowed pier mat surrounds at least three sides of the pier. The bowed mat is lowered so that the opposite end of the mat lies on the ground.

DETAILED DESCRIPTION OF THE INVENTION

According to a feature of the invention, set forth below are mats of erosion control blocks, spreader bars for installing the mats, and methods of installation of mats of articulated erosion control blocks in areas populated with piers, and the like. Conventional mats of erosion control blocks are constructed as rectangular arrays of blocks, and thus are easily installed side-by-side on flat and contoured ground areas. When the areas to be protected from erosion include vertical protrusions such as piers, poles, trees, etc., the installation of conventional mats of erosion control blocks presents a problem. The problem was overcome by the utilization of a mat of erosion control blocks that has a vacant edge space formed therein to encompass at least a part of the vertical protrusion.

Figure 1:
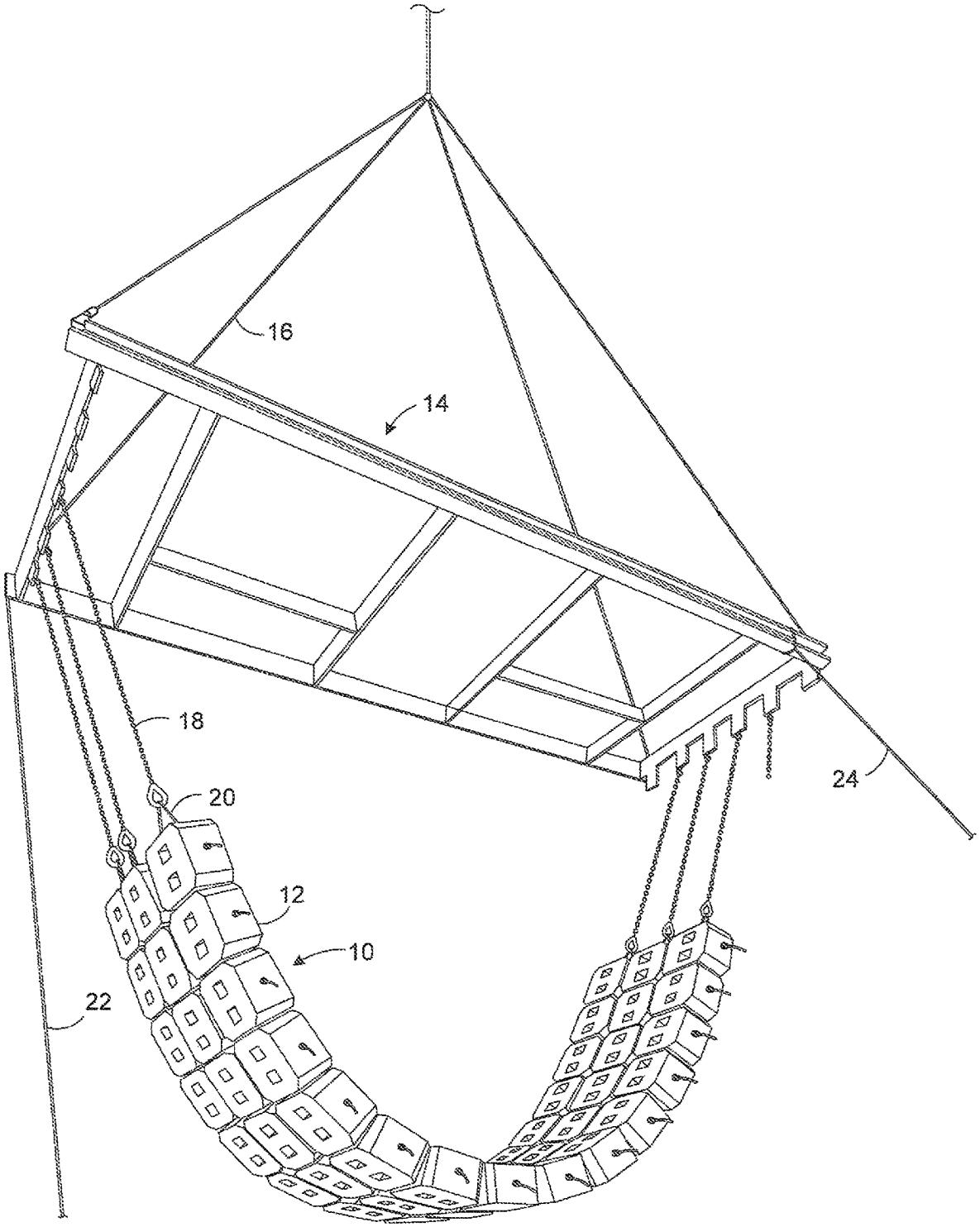
FIG.1 (Prior Art)
FIG. 1 is an isometric side view of a mat of erosion control blocks suspended by a spreader bar, all constructed according to the prior art.
Figure 2A:
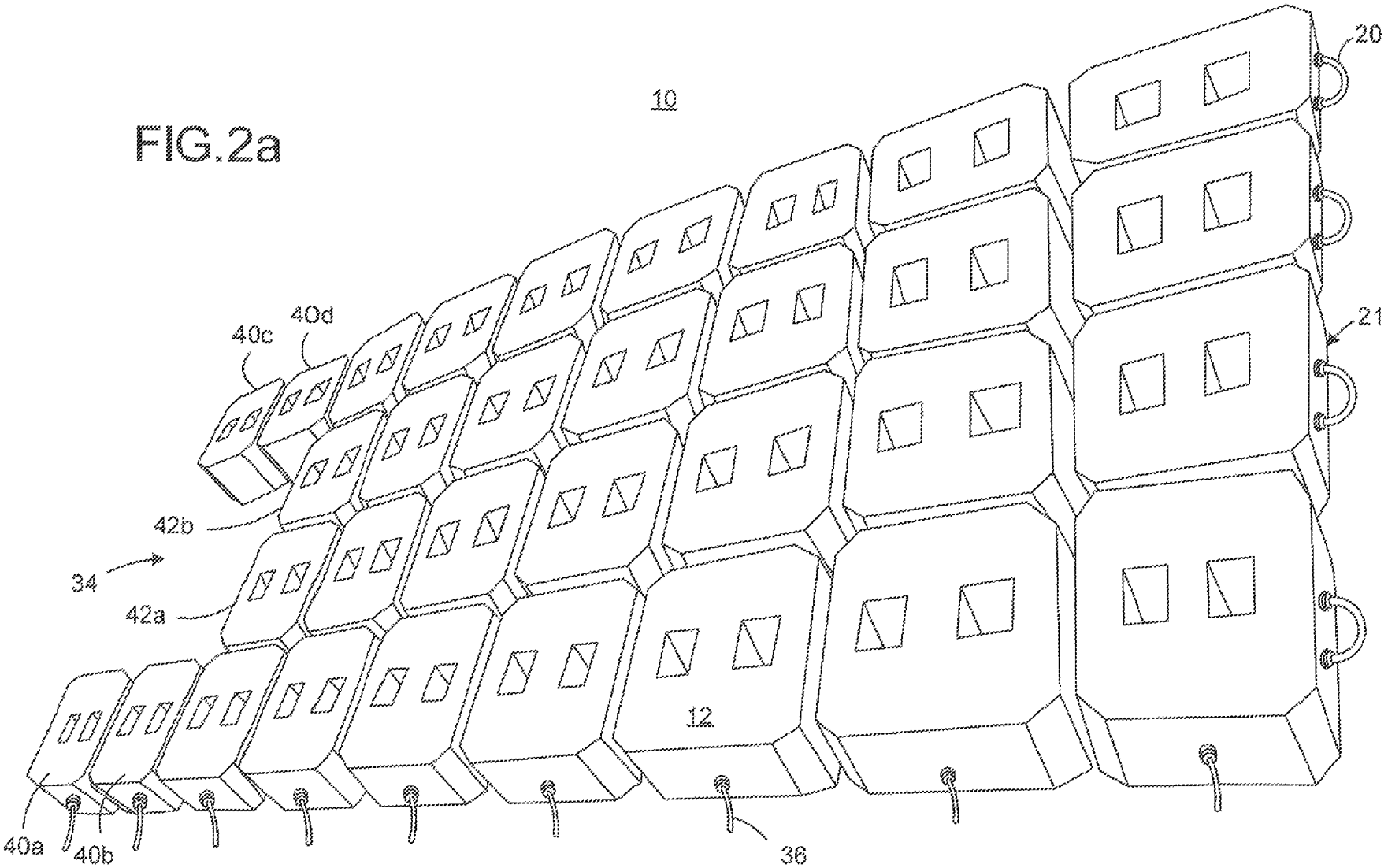
FIGS. 2*a* and 2*b* are respective isometric side and frontal views of an embodiment of a pier mat constructed according to the invention.
Figure 2B:
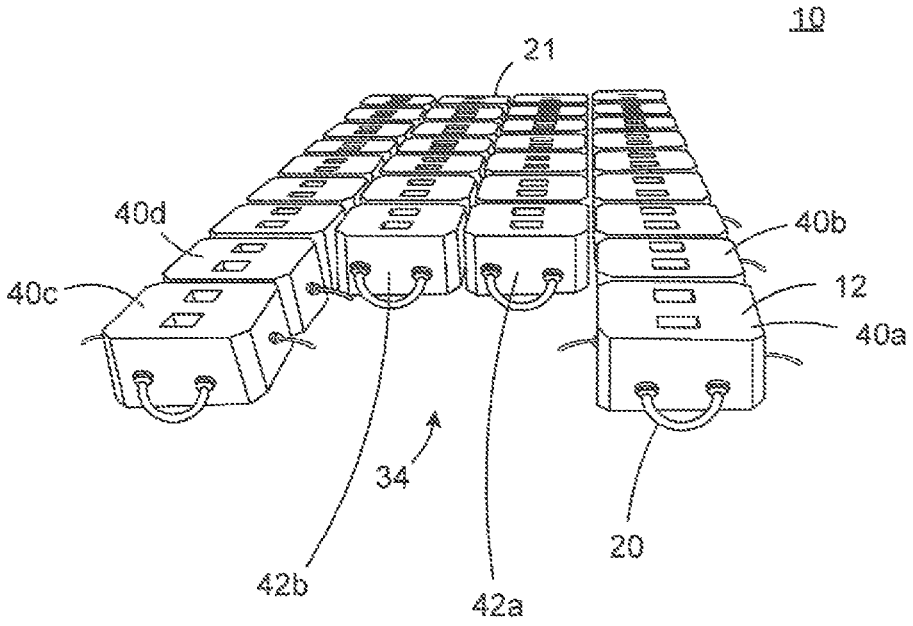
Figure 3:
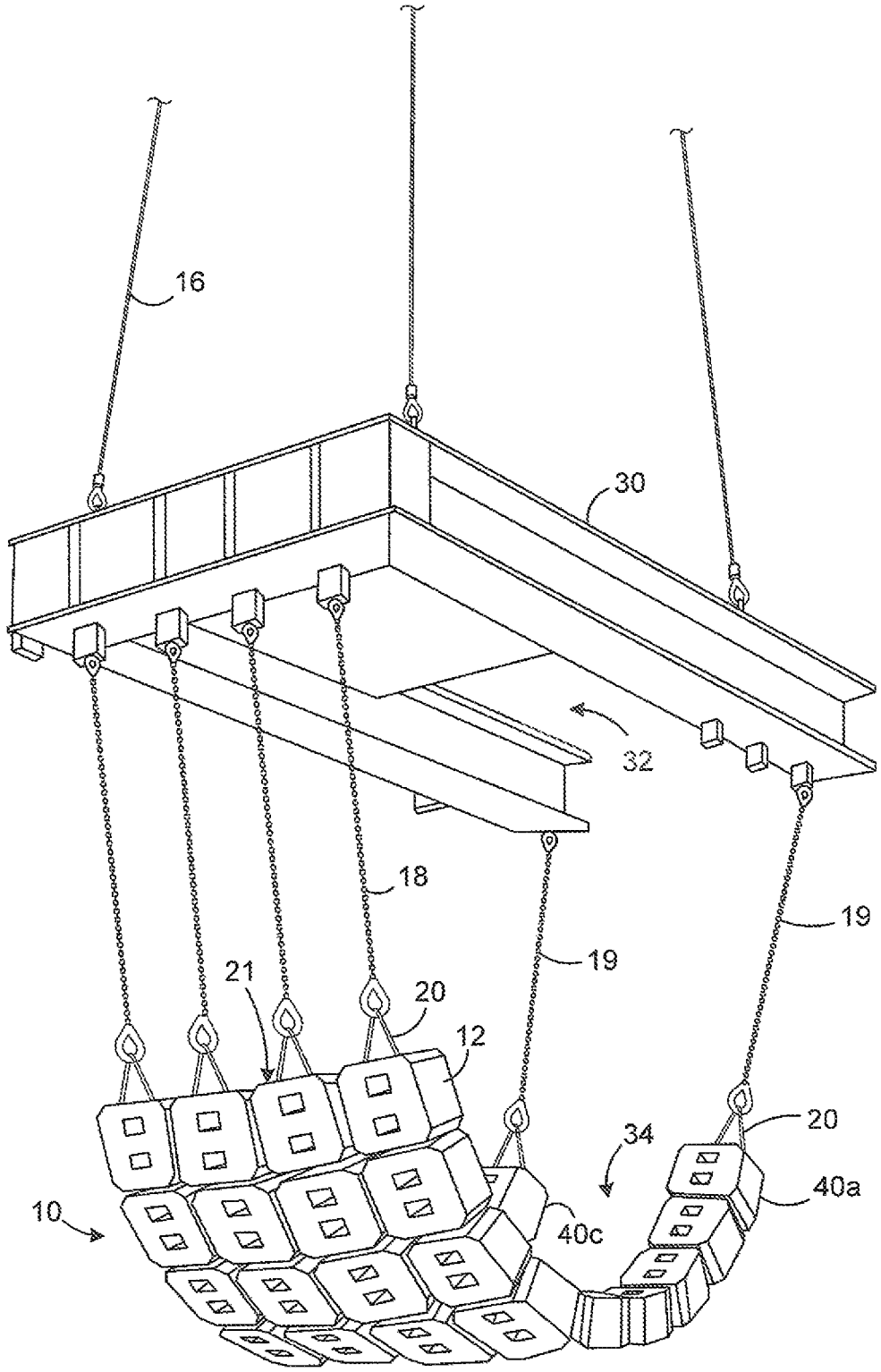
FIG. 3 is a view of an improved spreader bar supporting a pier mat of erosion control blocks of the invention.

The pier mat 10 of blocks of FIGS. 2*a* and 2*b* is constructed with a matrix of erosion control blocks 12 that are cabled together with synthetic or other cables 20 to hold the individual blocks 12 together as a mat 10. As used herein, when referring to the mat 10 of erosion control blocks 12, the opposite linear edges, and generally the longer edges, of a mat are termed the "sides", and the shorter opposite linear edge and the edge with the U-shaped vacant space are termed "ends." The cables 20 hold the blocks 12 of the pier mats 10 together when lifted by a spreader bar 30 (FIG. 3) to move the pier mat 10 from either the shore or a truck bed to the underwater location. The spreader bar 30 is connected to the looped cables 20 that extend beyond the opposite ends of the mat 10, and the mat 10 is then lifted. The central portion of the pier mat 10 that is suspended at the ends by the spreader bar 30 becomes arc-shaped, with the middle of the mat 10 bowed down in the middle, as shown in FIG. 3. It is noted that the mat 10 is not severely bowed, which otherwise could fray the cables 20 as they exit the cable channels formed within the blocks 12. As will be described in more detail below, the spreader bar 30 is constructed of heavy duty metal with a void 32 at one end that coincides vertically with the void 34 in the end of the mat 10. When lowered into position in the water and on the water-covered surface, the looped cables 20 at each end of the mat 10 can be connected by divers to the looped cables of adjacent mats. Any number of mats can be installed in the underwater location so as to cover a level or contoured area. As can be appreciated, when the underwater location is populated with one or more vertical protrusions, such as piers, then a mat of blocks shown in FIG. 1 is not easily employed. One reason is that the spreader bar 14 at one end would engage the pier and prevent the mat from being laid on both sides of the pier and close to the pier.

FIGS. 2*a* and 2*b* are isometric side views of the pier mat 10 of articulated erosion control blocks 12 adapted for use around vertical protrusions, such as harbor piers. Each block 12 is constructed in a manner similar to that illustrated in U.S. Pat. No. 8,678,705 by Smith et al, the subject matter of which is incorporated herein as if fully set forth herein. Thus, a new block need not be designed and constructed. As can be seen in FIG. 2*b*, the pier mat 10 is configured by threading cables 20 through each block 12 from one end of the mat 10 to the opposite end. More specifically, the cable 20 is threaded through one cable channel of the pair of cable channels in each block 12 in one direction through all the blocks 12 from one end to the opposite end of the mat 10, and then looped around and threaded back in the opposite direction through the other cable channel of the pair so that the two ends of the cable 15 are looped and attached together using a crimped sleeve. Other lateral cables are threaded through respective cable channels in one direction through each block in a row, from one side of the pier mat 10 to the opposite side. The pigtail ends 36 of the lateral cables extend from the side of each side block sufficiently, for example about nine inches, so as to be connected to the other similar pig tail cable ends of neighbor mats. A sleeve is crimped to each cable that exits either a side block or an end block to maintain the blocks tied together as a unit.

In the preferred embodiment, each erosion control block 12 is about 16" long, about 13" inches wide, and about 8" thick, and is adapted for a certain degree of articulation. In one embodiment, the pier mat 10 is constructed with 32 blocks. As will be described below, pier mats 10 having different numbers of blocks in a row and/or column can be employed in a single installation to accomplish the desired ground coverage. Each block 12 is constructed of concrete and weighs about 118 pounds. For greater weights, the blocks 12 can be made with larger dimensions to make the blocks 12 heavier and prevent moving or migrating as a result of rigorous wave movement.

In accordance with a feature of the invention, the pier mat 10 is formed with multiple blocks 12, where the pier mat 10 includes at least one area void of blocks 12, i.e., a cutout or vacant space, which is about the same size as the vertical protrusion to be encompassed by the mat 10 of erosion control blocks. In FIGS. 2*a* and 2*b* the vacant space in the pier mat 10 is identified with reference numeral 34. Moreover, the blocks 12 that border the vacant space 16 form a U shape. Here, there are four blocks missing from the mat 10, thus leaving the vacant space 34 in the end edge of the pier mat 10. The vacant space 34 is rectangular and about 32" inches by 26" inches, which is somewhat larger than the size and shape of a typical pier. The vacant space 34 will thus accommodate three sides of a rectangular pier of a size of about 24" by 24" which is a typical pier size that supports wharf platforms used by cargo loaded ocean-going ships. For piers that are somewhat smaller or larger than the size of the vacant space 34, different size or numbers of blocks 12 can be used to fabricate the mats 10, and/or for cylindrical-shaped piers the remaining uncovered area around the pier can be grouted to prevent erosion of the exposed soil.

As can be seen, the end edge of the pier mat 10 has a void space 34 that is bordered by blocks 12 forming a U-shape so that the pier mat 10 provides three sides that conveniently surround the corresponding three sides of either a rectangular-shaped (cross sectional) pier or a round pier or pole. Once the first pier mat 10 is installed with the down-slope vacant space 34 around three sides of the first pier, the length of the mat is sufficient so that the up-slope linear end of the pier mat 10 abuts the next up-slope pier, i.e., the second pier. The second pier mat is laid up-slope from the second pier mat 10 such that the vacant space 34 thereof surrounds the three sides of the second up-slope pier. Any ground area directly around the piers not covered with the blocks 12 can be grouted to prevent erosion. By continuing this technique, the piers are totally surrounded by erosion control blocks and erosion is prevented around the base of the piers. With this arrangement, the piers are aligned in the upslope and down-slope direction, and thus only the pier mats 10 need be utilized to accommodate the ground coverage around the piers. As will be described below, other conventional rectangular mats of erosion control blocks can be installed laterally between the pier mats 10 to fully cover the ground slope laterally located between the piers. These mats can be constructed with different widths and lengths to accommodate the spacing of the multiple piers in a row that support a wharf platform.

Figure 7:
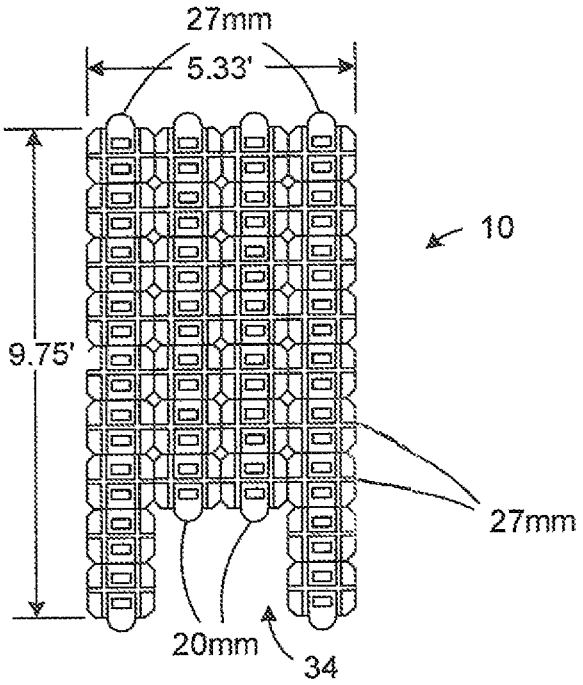

Referring again to FIGS. 2*a* and 2*b*, the pier mat 10 is illustrated with the vacancy 34 bounded by two leg blocks 40*a* and 40*b* in one outer column, and two other leg blocks 40*c* and 40*d* in the other outer column. Two base blocks 42*a* and 42*b* form the base of the "U" shape boundary of the vacant space 34. Thus, the U-shape in this embodiment of a pier mat 10 includes two base blocks 42*a* and 42*b* and two spaced apart sets of leg blocks 40*a*-40*d*. This pier mat 10 is shown in FIG. 7 and is 5.33' wide×9.75' in length. This pier mat 10 is constructed with thirty two (32) erosion control blocks so that the actual surface area of the mat coverage is 46.08 square foot, and weighs 78 lbs per square foot, or 4,053 lbs per mat 10.

Conventional spreader bars that were considered for lifting the pier mats 10 did not satisfy the factor of safety (FOS) required by OSHA. According to OSHA standards and guidelines, a minimum FOS of 5 is required for the lifting of mats with respect to cable strength and lifts. The specialized spreader bar 30 adapted for lifting the pier mat 10 is illustrated in FIG. 3, and relies on the premise that the entire "U" shaped mat weight be distributed on the looped cables 20 threaded through the outer columns of blocks 12. This condition is considered when calculating the Factor of Safety during lifting of the pier mats 10. Since the base blocks 42*a* and 42*b* of the void 34 are not used in lifting the pier mats 10, the inner cables threaded through the base blocks 42*a* and 42*b* do not distribute any mat weight during lifting and thus cannot be considered when analyzing a FOS calculation for lifting the pier mats 10. The calculation below shows the equation in cable strength calculations in determining the FOS:

Cable Strength 27 mm–Four (4)×7,200=28,800/4,
053=FOS 7.10

Since the FOS is greater than the required parameter of 5, the pier mat lifting technique is approved for use with the stronger 27 mm cable.

Figure 5:
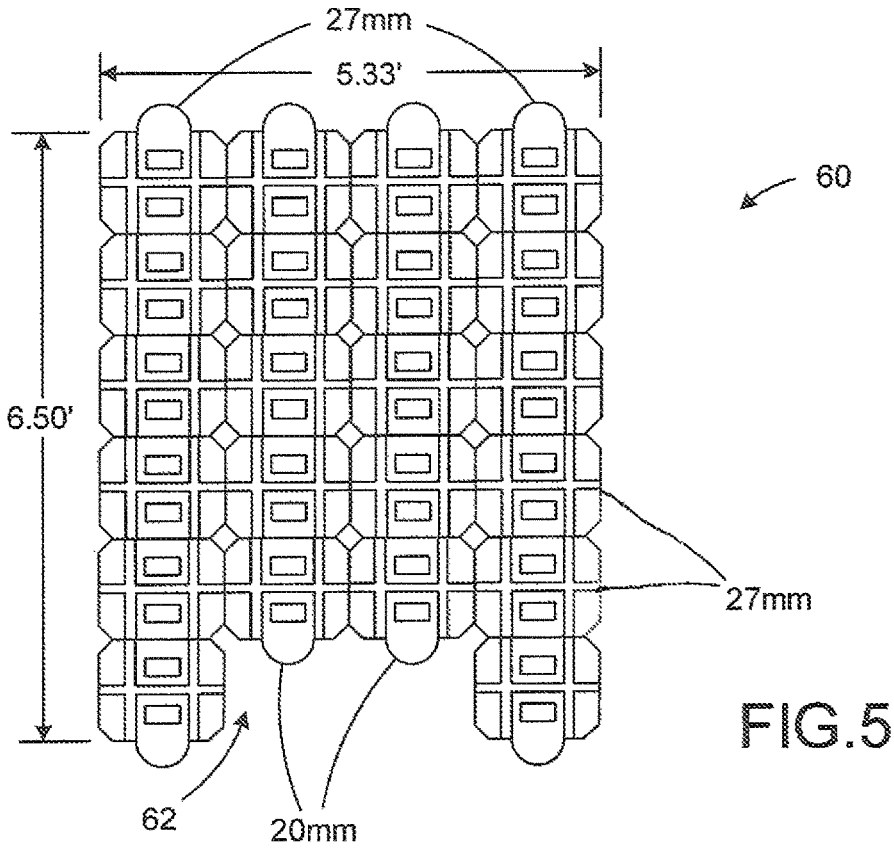

The mat 60 of FIG. 5 has the dimensions of 5.33'×6.50' and has only one leg block per leg that extends beyond the two base blocks of the vacant space. The pier mat 60 is illustrated in use in FIG. 12. This is due to circular piers that were installed on the slope with a much larger diameter size, as compared to the other square concrete piers used throughout the major slope portion of concrete piers. Circular piers will most likely carry an increased and different distributed weight load for new wharf terminals being built above water. The lower sets of square concrete piers are 24" by 24", while the upper sets of square concrete piers are 36"×36" square, whereas the circular piers generally have a radius of 24". The ACM fit uniformly around the four linear side edges of the square piers, while the ACM fits a little off due to the large circular piers. The ACM could not fit precisely on the circular side edges of the circular piers without saw cutting the blocks, which is not recommended. As noted above, all gaps between the ACM and concrete circular piers are filled with a suitable concrete mix. This will seal any open gaps between the concrete piers and the ACM so no erosion or scouring will occur around the small gaps between the pier mat blocks and the circular piers.

When the pier mats were first lifted, a slight deflection was noted in the two base blocks forming the base of the vacant space 34. This was due to not having the base blocks fully extended to the end of the mat with cable lifting loops extending therefrom, which would be consistent with the manner in which previous ACM had been lifted for the past sixty years. In order to add strength and reduce slight block deflection, a heavier 27 mm cable was threaded from side to side of the pier mat, but only on the two adjacent block rows, one of which includes the base blocks. Reference is made to FIGS. 4-7 which show the placement of the 27 mm cable through the blocks of each type of pier mat. The 27 mm cable allowed the mats to be lifted much better, showed less deflection, showed added cable strength side to side for the mat of blocks and was a much greater value in comparison to the 20 mm cables.

Figure 6:
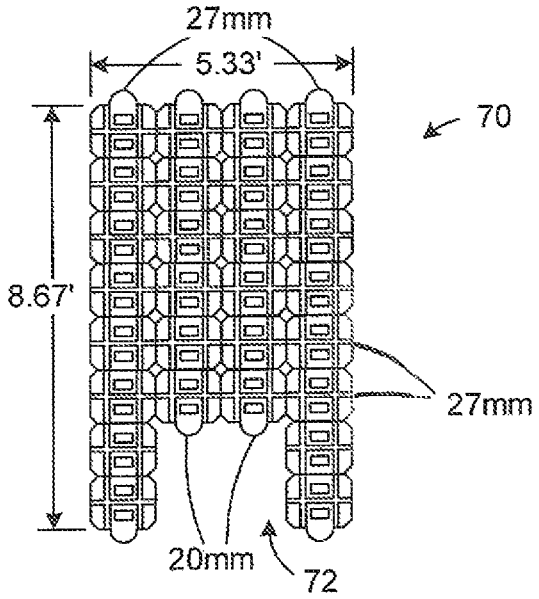

FIGS. 5-7 illustrate the manner in which a 27 mm longitudinal looped cable is threaded through the blocks in the columns of the pier mats 60, 70 and 10. The looped interior cables that are threaded through the base blocks, which are not a factor in the FOS for lifting, can be either the smaller of 20 mm or 27 mm. The looped interior cables do not affect the FOS for lifting since the mat is not lifted from the base blocks of the mats. The pier mats of FIGS. 4-7 show the 27 mm lateral cable which is utilized on the two block rows adjacent to the base blocks in each mat. All other lateral cables can be the smaller 20 mm cable, but in practice are made larger to provide added strength for the slight deflection of the two inner rows of blocks.

Referring back to FIG. 3, there is illustrated a pier mat 10 of erosion control blocks of the type that includes the vacant space 34 formed in one end edge of the mat 10. The pier mat 10 is lifted using the spreader bar 30 that is hoisted by a crane (not shown) using chains 16 attaching the spreader bar 30 to the crane line. The spreader bar 30 is connected to the linear end edge 21 of the mat 10 using one set of four chains 18. Each chain 18 is connected to a loop 20 that extends from the end blocks 12, it being understood that each cable forming the loop 20 extends through the blocks in the column and through respective parallel cable channels in each column block. Each erosion control block 12 in the column is constructed with two other parallel cable channels formed therethrough, where the cable exits a block 12 at the mat edge and is looped around the block 12 and is threaded back into the other channel of the block 12. The other columns of blocks 12 of the mat 10 are cabled in the same manner. Accordingly, there is a cable loop 20 extending from each block of the linear edge 21 of the pier mat 10. In other words, if there are four columns of blocks in the mat 10, there would be four loops at the linear edge 21 of the mat 10. As noted above, each lateral row of blocks 12 is cabled together with a single cable which terminates in a pigtail end 36, shown in FIG. 2*a*. The manner in which the pier mats 10 and conventional rectangular mats of blocks are anchored together will be described below.

At the opposite end of the mat 10 of FIG. 3, i.e., the end having the vacant space 34, there are two spreader bar chains 19 that each connect to a respective cable loop that extends from the leg blocks 40*a* and 40*c*. As described above, the leg blocks 40*a* and 40*b* form a part of the border of the vacant space 34. In accordance with an important feature of the invention, the spreader bar 20 is constructed with a corresponding U-shaped vacant area 32 that corresponds generally with the size of the vacant space 34 of the pier mat 10. With this arrangement, the crane can lower the pier mat 10 so that the aligned spreader bar vacant space 32 and the vacant space 34 of the pier mat 10 can together engulf or surround the pier on three sides thereof. The installation of the mats 10 in this manner can be accomplished when the piers have been installed on the floor of the sea bed, but before the wharf platform has been constructed over the piers.

Figure 4:
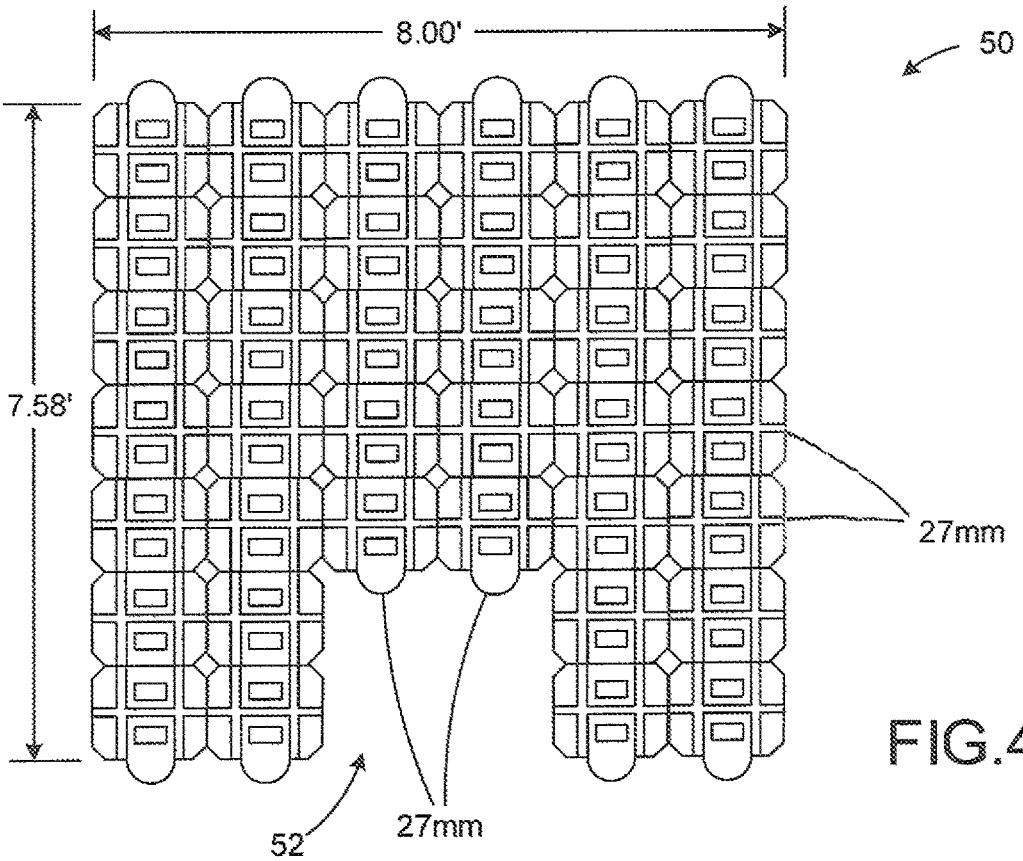
FIGS. 4-7 illustrate different configurations of pier mats that can be employed at an installation site.

Preferably, a pier mat 10 of the erosion control blocks 12 is constructed so that the length thereof, from the base blocks 42 of the U-shaped vacant space 34 to the opposite linear end 21, is the same length as the up-slope/down-slope distance between the adjacent piers. FIGS. 4-7 illustrate a number of different configurations of pier mats. The pier mat 50 of FIG. 4 is six blocks wide from side to side, and includes a vacant space 52 bounded by two base blocks and two legs each of which is two blocks long. All synthetic cables, both lateral and looped longitudinal, are 27 mm in diameter. The pier mat 60 of FIG. 5 is constructed four blocks wide from side to side, and includes a vacant space 62 bounded by two base blocks and two legs each of which is one block long. The lateral cables are all 27 mm in diameter. The two outer columns of blocks which sustain the lifting weight of the pier mat 60 at the U-shaped end are 27 mm in diameter. The looped longitudinal cables extending along the two inner columns are 20 mm in diameter. The two inner columns of blocks terminate in the base blocks. The pier mat 70 of FIG. 6 is four blocks wide from side to side, and includes a vacant space 72 bounded by two base blocks and two legs each of which is two blocks long. The lateral cables are all 27 mm in diameter, but the looped longitudinal cables that extend through the two inner columns are 20 mm in diameter. The two outer columns of blocks which sustain the lifting weight of the pier mat 70 at the U-shaped end are 27 mm in diameter. The pier mat 10 of FIG. 7 illustrated above in FIGS. 2*a* and 2*b* is four blocks wide from side to side, and includes a vacant space 34 bounded by two base blocks and two legs each of which is two blocks long. The lateral cables are all 27 mm in diameter, as are the two outer columns of blocks. The looped longitudinal cables of the two inner columns of blocks that terminate in the base blocks are 20 mm in diameter. In each case of the pier mats 10, 50, 60 and 70, the lateral cables are terminated in pigtail ends, where each end has a sleeve crimped thereto to prevent the lateral cable from slipping back through the block through the cable channel of the side block.

The crimped sleeves are well known in the art for use with synthetic cables to hold the blocks of a mat together. In practice, a washer is slipped over the cable and moved adjacent the end of the block cable channel, and then the metal sleeve is crimped next to the washer. The washer prevents the crimped sleeve from being forced into the cable channel. Those skilled in the art are familiar with the use of crimped sleeves on synthetic ropes threaded through revetment blocks. The technique of using lateral synthetic ropes and crimped sleeves to hold the columns of blocks together is applicable to the rectangular mats of blocks illustrated in FIGS. 8-11. It should be understood that the ends of the lateral cables that extend beyond the crimped sleeves are anchored to the corresponding pig tail ends of a neighbor mat, and the two lateral cables are crimped together to anchor the two mats side by side.

Figure 9:
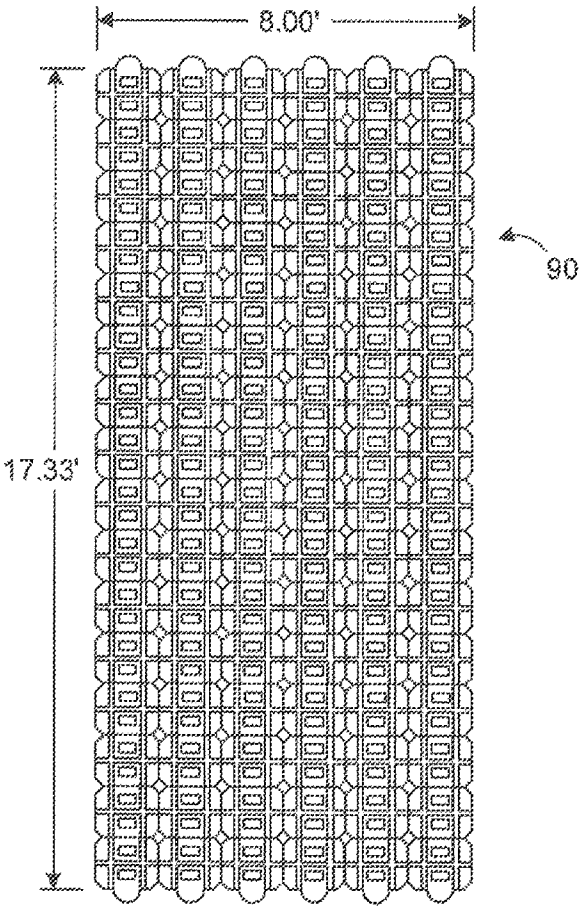
FIGS. 8-9 illustrate different configurations of rectangular mats that can be used in conjunction with the pier mats of FIGS. 4-7 to fully cover an area around piers.
Figure 8:
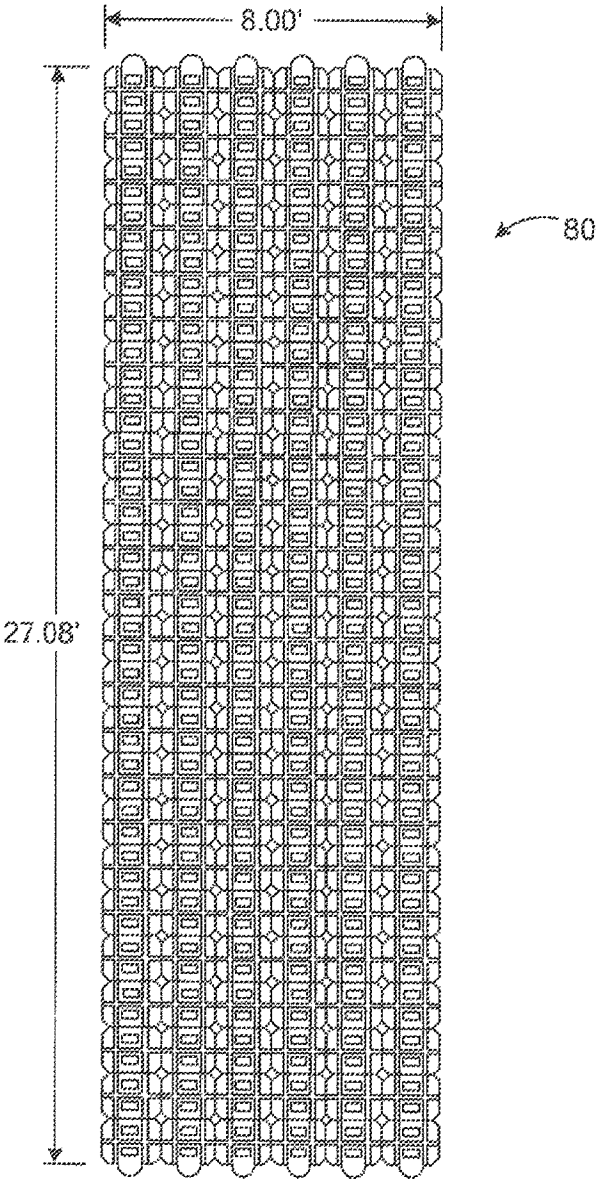
Figure 11:
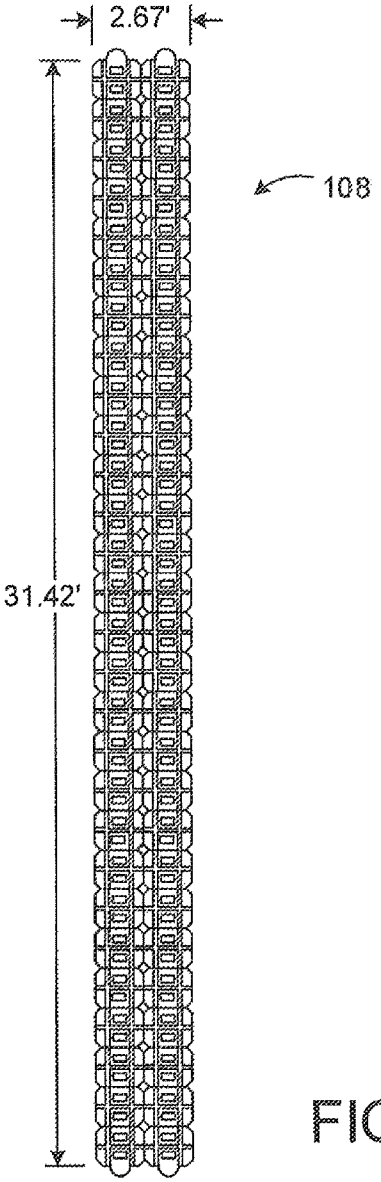
FIGS. 10-11 are top views of toe mats of erosion control blocks.
Figure 10:
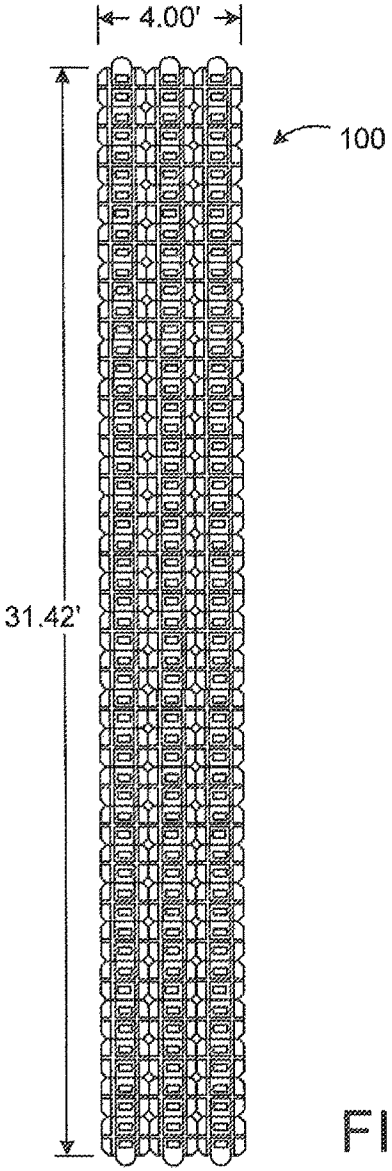

FIGS. 8-11 illustrate other conventional rectangular mats of blocks that are used in conjunction with the pier mats to fully cover the sloped ground in which the piers are installed. The mat 80 of FIG. 8 is formed of the same type of blocks as the pier mats, but is configured with a matrix of six blocks from side to side, and twenty-five blocks from end to end. The mat 90 of FIG. 9 is a rectangular mat constructed with six blocks from side to side, and sixteen blocks from end to end. The mat 100 of FIG. 10 is a rectangular mat constructed with three blocks from side to side, and twenty-nine blocks from end to end. The mat 108 of FIG. 11 is a rectangular mat constructed with two blocks from side to side, and twenty-nine blocks from end to end. Each mat covers a different area, and is useful when covering the ground area of the example wharf area of FIG. 12.

Figure 12:
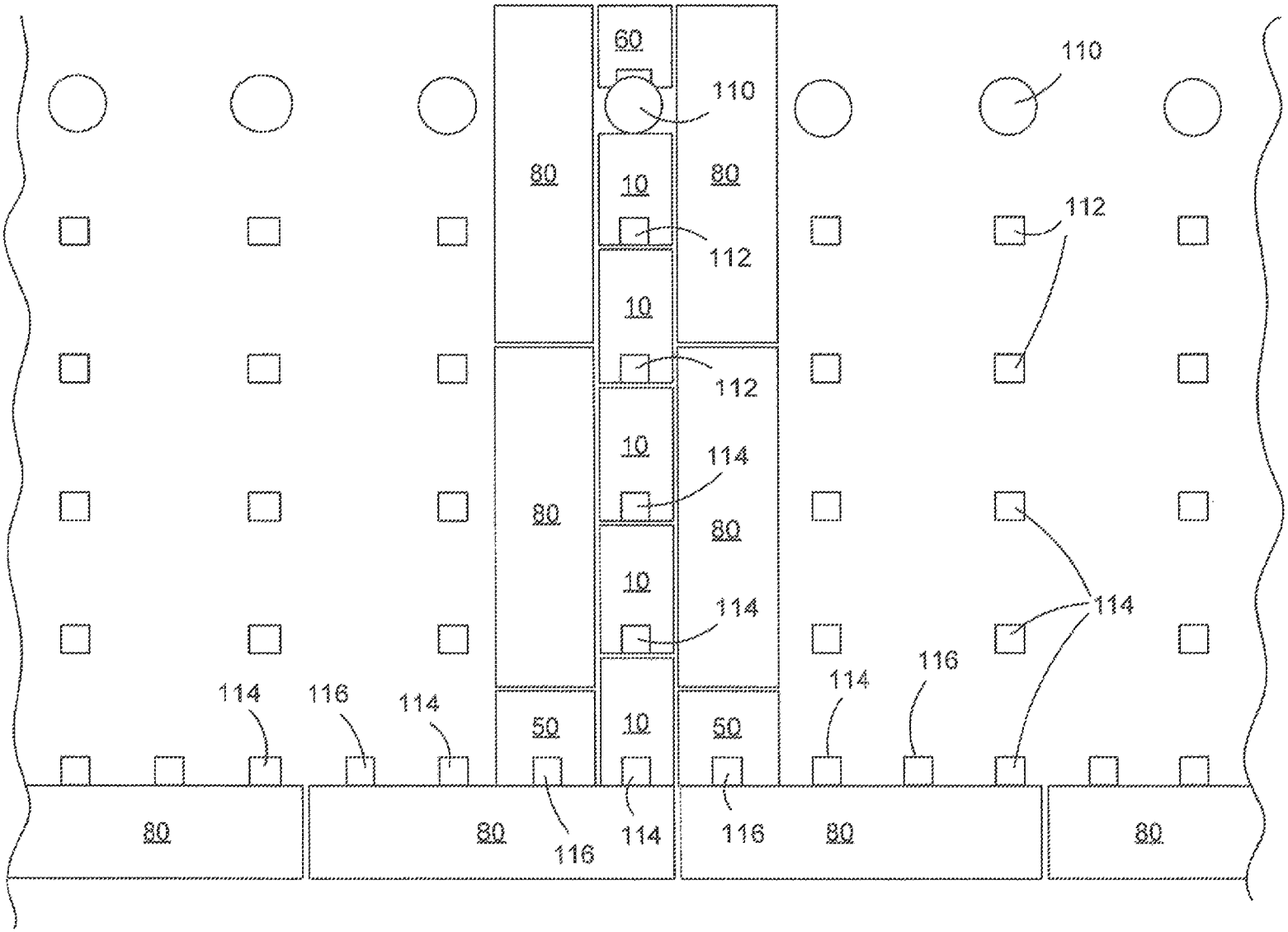
FIG. 12 is a portion of an installation site illustrating a typical section of the different types of erosion control block mats used around piers.

With reference to FIG. 12, there is illustrated a top view of a typical sloped wharf area where the piles or piers have been installed before the overlying wharf platform. The larger circular piers 110 are installed on the up-slope part of the sloped ground. The piers 110 adjacent to the land side of the wharf are round in cross section and are generally about 48" in diameter. Proceeding down-slope, the next two piers 112 are rectangular piers having dimensions of about 36" by 36". Lastly, the next three down-slope piers 114 are about 24" by 24". The piers 114 that are located the most remote, have other similar size piers 116 installed therebetween. The last set of piers down-slope have twice the density as the other rows of piers.

The ACM layout of FIG. 12 is carried out by installing a layer (bottom of FIG. 12) of toe mats 80 (FIG. 8), end to end, across the bottom of the slope so that the up-slope sides of the toe mats 80 abut against the lower edges of lateral row of high density piers 114 and 116. The pier mats 50 (FIG. 4) are then installed just above the bottom piers 116. Continuing up the slope to be covered, two of the rectangular mats 80 are installed end to end up-slope from the respective pier mats 50. In between the pier mats 50 and mats 80 of FIG. 12, four of the pier mats 10 (FIG. 7) are each installed up slope around respective smaller square piers 114. Between the larger 36" by 36" square piers 112 another pier mat 10 (FIG. 7) is installed. Because the upper round pier 110 is larger than the square piers, a pier mat 60 (FIG. 5) is installed above such pier 110. This pattern of conventional rectangular mats and pier mats is repeated across the sloped grade to the right and left to fully cover the ground around and between each of the piers. As noted above, any uncovered area, such as that around the round piers 110, is grouted or cemented to prevent erosion thereof.

While the rectangular mats 100 (FIG. 10) and 108 (FIG. 11) are not illustrated in FIG. 12, such mats can be employed when the lateral spacing between the rows (left-right) of piers 110, 112, and 114 is smaller than shown in FIG. 12.

Figure 13:
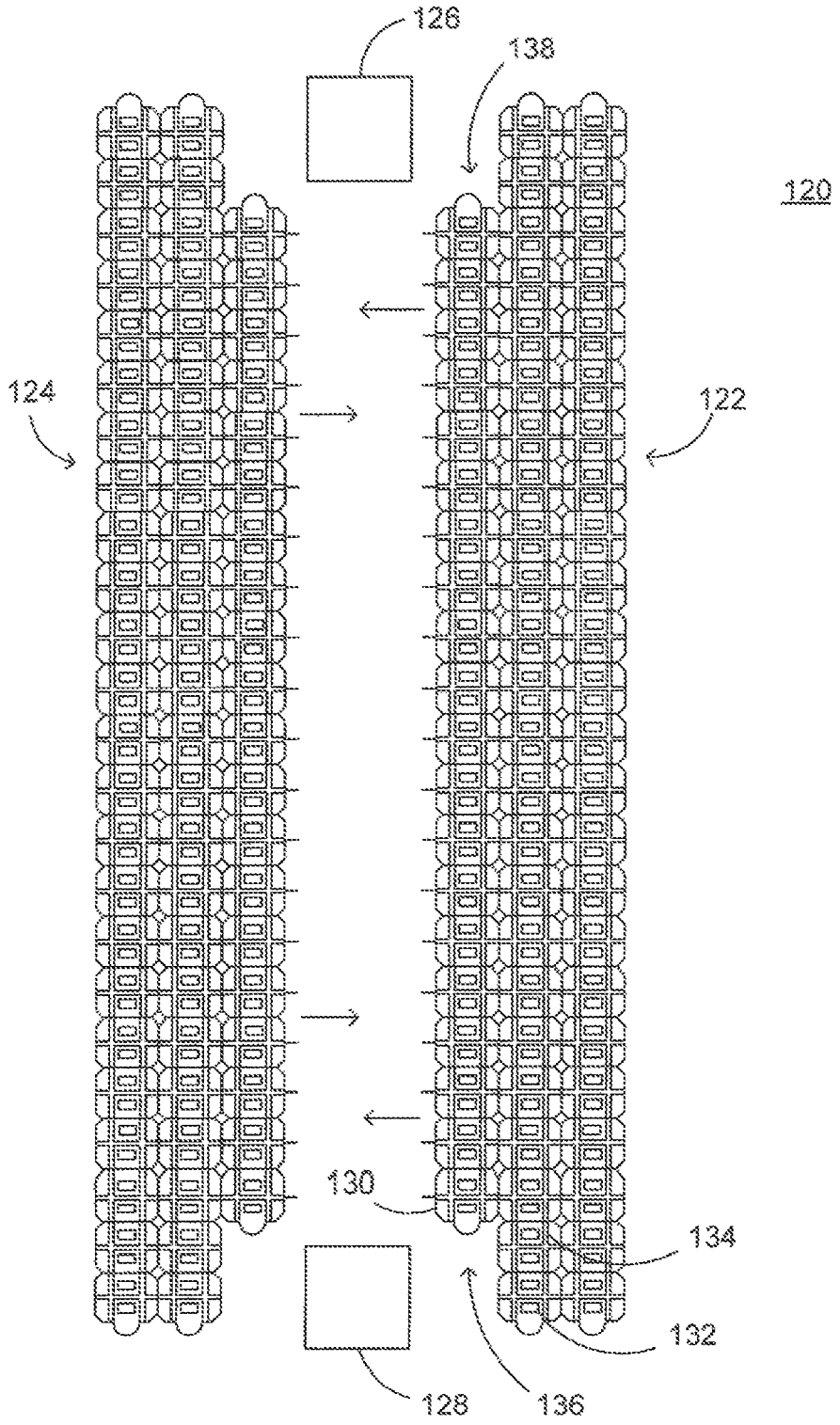
FIG. 13 illustrates another embodiment of a two part pier mat.

According to another embodiment of the invention, FIG. 13 illustrates a pier mat set 120. The pier mat set 120 includes two mat parts 122 and 124 which, when installed or moved together in the direction of the arrows, is adapted to surround one or more piers 126 and 128. The pier mat part 122 is assembled with a single base block 130 and two leg blocks 132 and 134 to form a void or cutout 136. The opposite end of the pier mat part 122 is assembled in a similar manner so as to have a void or cutout 138. As an alternative, the opposite end of the pier mat part 122 may not include the cutout 138, but can be linear. The other pier mat part 124 can be assembled in a similar manner. The cutouts 136 and 138 together can be of a size to accommodate the full width of the piers 126 and 128, but only one half of the length of the piers 126 and 128. In this manner, other similar pier mat sets 120 can be installed above the pier 126 and below the other pier 128 so as to fully encompass the piers 126 and 128. The pier mat parts 122 and 124 are anchored together by crimping a sleeve on the respective pigtail ends on the right side of pier mat part 124 to the pigtail ends on the left side of the other pier mat part 122. In this embodiment, it can be seen that when the pier mat parts 122 and 124 are installed so as to be adjacent each other, the piers 126 and 128 are encircled on three sides thereof. The number of blocks chosen to assemble the pier mat set 120, both side-to-side and lengthwise and those which form the void, can be different from that illustrated.

Figure 14:
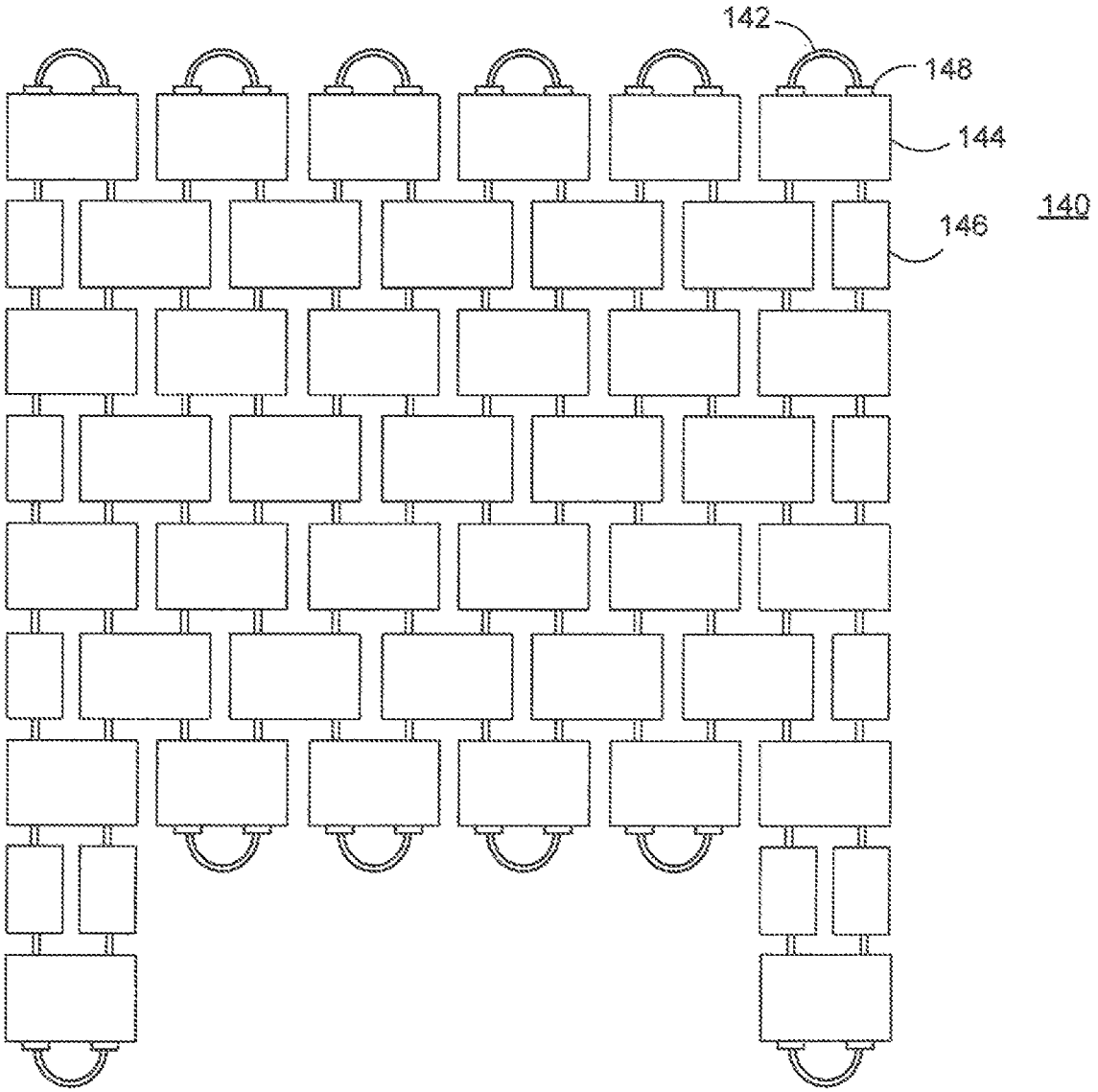
FIG. 14 is a top view of a pier mat assembled using staggered columns of blocks.

FIG. 14 illustrates an arrangement of revetment blocks that are staggered as to the columns to form a pier mat 140. In this arrangement, the matrix of blocks 144 are fabricated so as to have only two parallel cable channels formed therethrough, except for the half blocks 146 which have only one cable channel extending therethrough. The cable channels extend through the blocks along the columns of the staggered blocks. For each cable that extends along a column, the blocks of that column are arranged in a zig zag manner. As can be seen there are no cable channels that are perpendicular to the two parallel cable channels, as is the case with the blocks 12 described above. In FIG. 14, it is seen that every other row of blocks 144 are full blocks, and the alternate rows are full blocks except for the opposite ends of the rows where there are half blocks 146.

The cables, such as cable 142, are threaded through the blocks along the columns of blocks, looped at the bottom end, and then threaded back upwardly through the other cable channel of the full blocks to the top end, and then looped and crimped to the other end of the cable. As can be seen, there are six individual cables that extend with the columns, where each cable has a loop at both ends for lifting. Further, a crimp 148 and washer (not shown) is fastened to each cable where it is looped at both the top and the bottom of the pier mat 140.

Figure 15:
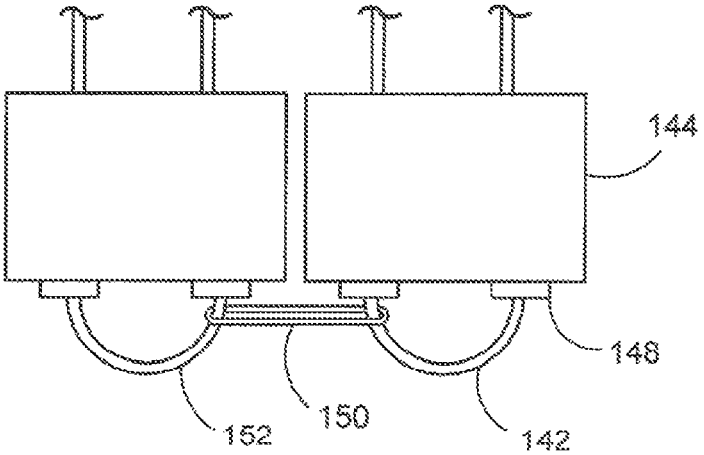
FIG. 15 is a top view of two end blocks that are tied together using a zip tie.

In the event that additional lateral stability of the end blocks (top and bottom) in a staggered column is required, a zip tie 150 of suitable strength can be secured around the cable 142 of one block and the cable 152 of the neighbor block. An illustration of this feature is shown in FIG. 15. The zip tie 150 limits the lateral movement of neighbor blocks at the ends of the pier mat 140 since no lateral cables are utilized.

Figure 16:
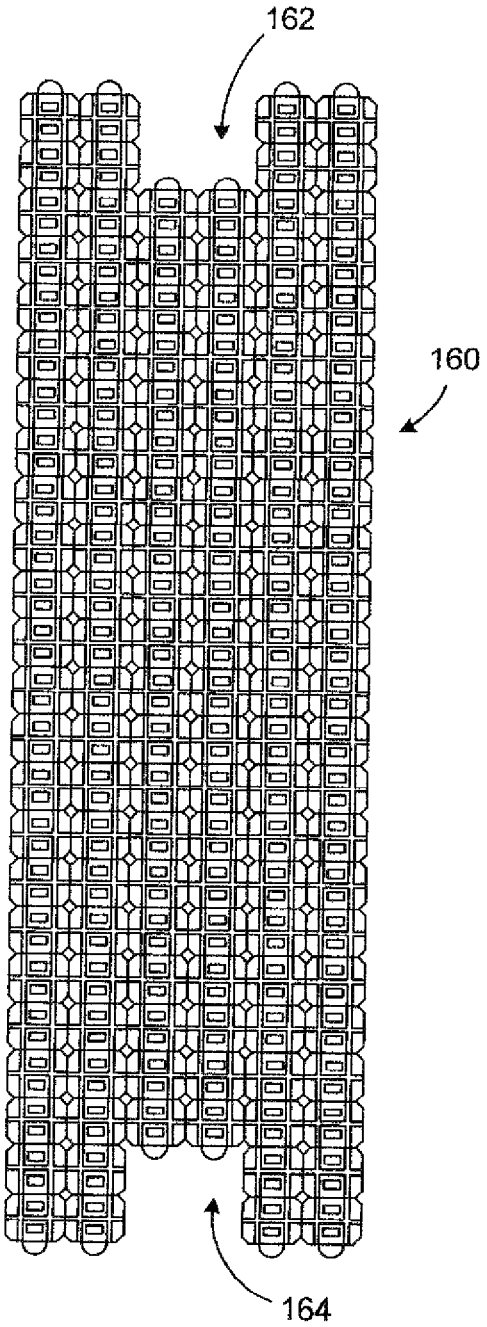
FIG. 16 is a top view of a pier mat having a vacant space at opposite end edges.
Figure 17:
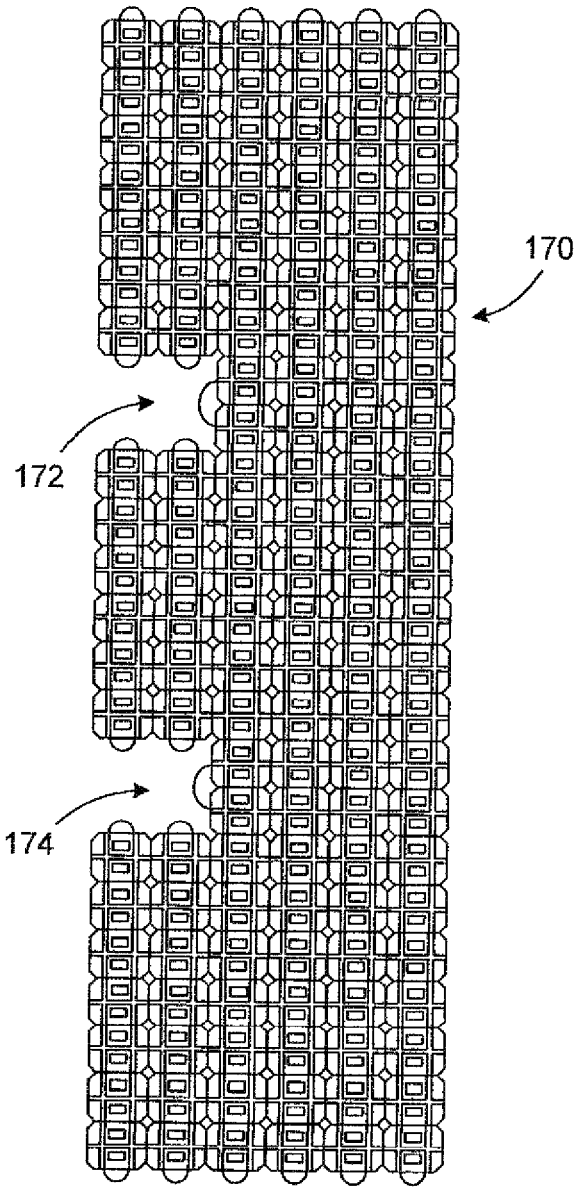
FIG. 17 is a top view of a pier mat having two vacant spaces on a side edge thereof.
Figure 18:
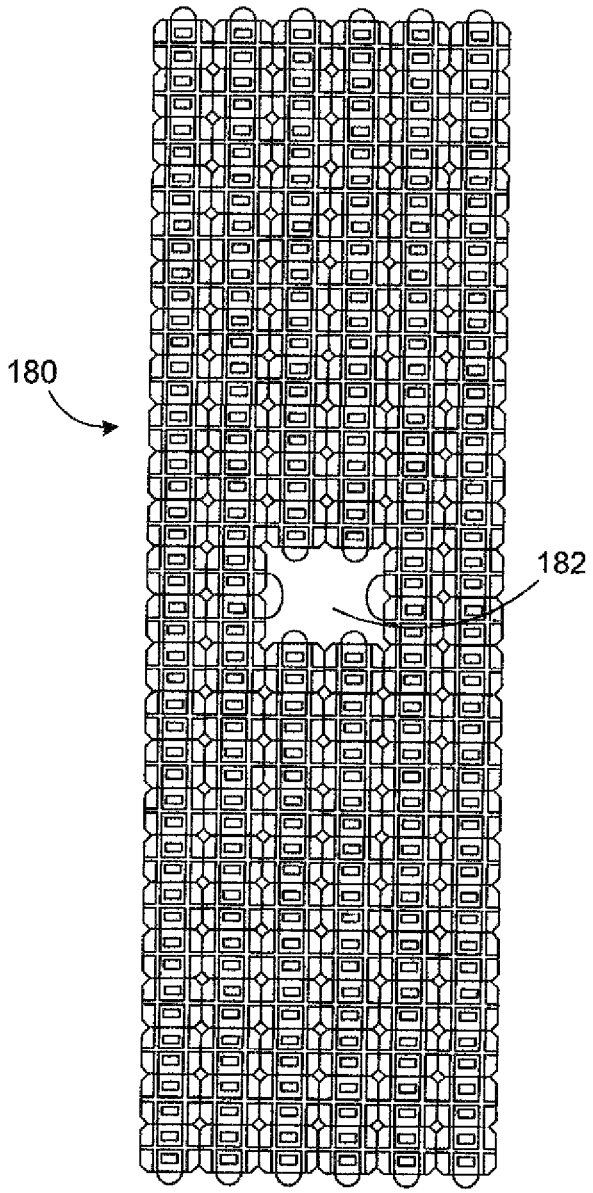
FIG. 18 is a top view of a pier mat having a vacant space formed within the mat.

The various pier mat embodiments described herein are constructed with two linear sides, a linear end, and an opposite end that has a vacant space. The vacant space has a border defined by one or more base blocks, and two legs each of which has one or more blocks. The border blocks form a U shape that is cut out into the pier mat. Those skilled in the art may find that the pier mats 170 can be constructed with two or more vacant spaces 172 and 174 in one side (FIG. 17) or in multiple sides of the mat. Similarly, two or more vacant spaces can be formed in either end or both ends of the pier mat. The pier mat 160 can have a vacant space 162 and 164 at opposite ends of the mat 160, thus accommodating two piers at each end of the mat 160 (FIG. 16). Further, the vacant space need not be U-shaped, but can be other shapes to accommodate the shapes of other vertical obstacles. According to the invention, the void space 182 can be formed with four sides and located within the mat 180 of blocks (FIG. 18) so that when installed, the mat is lowered over the pier so that the pier protrudes through the void space. In this case, the void space is not formed in an edge or side of the mat.

While the preferred and other embodiments of the invention have been disclosed with reference to specific pier mats of erosion control blocks, and associated methods of fabrication and installation thereof, it is to be understood that many changes in detail may be made as a matter of engineering choices without departing from the spirit and scope of the invention, as defined by the appended claims.

What is claimed is:

1. A mat of erosion control blocks, comprising:

a plurality of blocks arranged in a matrix to form said mat;

said matrix having a single vertical layer of said erosion control blocks so that said blocks of said plurality are not stacked on top of each other;

a vacant space in said mat defined by an absence of one or more blocks of said plurality of blocks, the blocks of said mat arranged to provide said vacant space, and said vacant space for receiving therein at least a portion of a vertical object;

plural cables for cabling the blocks of said mat together, said cables extending beyond opposite ends of said mat and forming loops for lifting said mat, said cables do not extend through said vacant space from one end to an opposite end thereof so that the vertical object can be located within said vacant space, and at least one cable loop located within said vacant space for holding various blocks of said mat together and said at least one cable loop is not used for lifting said mat during installation when said vacant space receives therein the portion of the vertical object; and said matrix comprises x number of rows of said blocks, and the mat of said blocks is constructed with one of the opposing ends having said vacant space, and the opposite end of said mat not having a vacant space, wherein said opposite end not having the vacant space has x number of said cable loops for lifting said opposite end of said mat, and said mat end having said vacant space has fewer than x number of said cable loops for lifting the mat end having said vacant space.

2. The mat of erosion control blocks of claim 1, wherein said vacant space is formed inwardly from one of an end or a side of said mat to accommodate therein at least a portion of a pier.

3. The mat of erosion control blocks of claim 1, wherein said mat is constructed with a width shorter than a length thereof.

4. The mat of erosion control blocks of claim 1, wherein said matrix comprises plural rows of said blocks, and wherein a boundary of said vacant space is U-shaped and bounded by one or more base blocks, and said matrix comprises two legs of blocks for said vacant space where each said leg is parallel to each other, and where the blocks of one said leg are spaced-apart from the blocks of the other said leg.

5. The mat of erosion control blocks of claim 4, wherein said blocks of said plurality each have one or more cable channels formed therethrough, and said mat has a linear edge at one end of said rows, and said cable loops used for lifting said mat extend from the blocks of said linear edge, and further including at least one said cable loop extending from each said leg of said two legs, said cable loops extending from said legs for lifting said mat.

6. The mat of erosion control blocks of claim 1, wherein said mat defines a first mat, the one end of said first mat is linear, and the opposite end of said first mat has said vacant space therein, and further including a second mat with blocks arranged similar to the blocks of said first mat so as to have a linear end and an opposite end having a vacant space, said first mat is located so that said linear end thereof is adjacent to the vertical object, and the vacant space of said second mat at least partially surrounds the vertical object, whereby said first and second mats form an enclosed area so that the vertical object is substantially surrounded by said first and second mats.

7. The mat of erosion control blocks of claim 6, wherein the vertical object comprises a pier, and wherein said enclosed area is bounded by the blocks of said first and second mats that surround the pier.

8. The mat of erosion control blocks of claim 1, wherein said mat is located underwater so that said vacant space at least partially surrounds the vertical object.

9. A method of installing a pier mat of erosion control blocks, comprising:

using a spreader bar structure for lifting and moving said pier mat, said spreader bar structure having opposing ends for lifting respective opposing ends of said pier mat, and said spreader bar structure having a vacant space located at one said end of said spreader bar structure, the vacant space of said spreader bar structure is associated with a vacant space formed in said pier mat;

lifting the pier mat of erosion control blocks at each end of said opposing ends of said pier mat with said spreader bar structure so that said pier mat bows downwardly between said two opposing ends, and one said end of said opposing ends of said pier mat has said vacant space formed inwardly from said one said end, said vacant space of said pier mat having a size for accepting therein at least a portion of a pier;

moving the bowed pier mat of said erosion control blocks adjacent the pier so that said vacant space of said bowed pier mat and the vacant space of said spreader bar structure both surround at least three sides of the pier; and lowering the bowed pier mat with said spreader bar structure so that the opposite ends of said pier mat lie on a ground surface into which the pier is embedded.

10. The method of claim 9, wherein said pier mat defines a first pier mat, and the pier defines a first pier, and further including lowering the bowed first pier mat so that a linear end thereof lies adjacent to a second pier, and further including lowering a second pier mat similar in construction to said first pier mat so that an end of the second pier mat having a vacant space at least partially surrounds the second pier and lies adjacent to the linear end of said first pier mat.

11. The method of claim 9, further including installing said pier mat underwater on a sloped surface.

12. The method of claim 9, further including installing a plurality of said pier mats around respective piers.

13. A mat of erosion control blocks, comprising:

a plurality of blocks arranged in a matrix to form said mat;

said matrix having a single vertical layer of said erosion control blocks so that said blocks of said plurality are not stacked on top of each other;

a vacant space in said mat defined by an absence of one or more blocks of said plurality of blocks, the blocks of said mat arranged to provide said vacant space, and said vacant space for receiving therein at least a portion of a vertical object;

plural cables for cabling the blocks of said mat together, said cables extending beyond opposite ends of said mat and forming loops for lifting said mat, said cables do not extend through said vacant space from one end to an opposite end thereof so that the vertical object can be located within said vacant space, and at least one cable loop located within said vacant space for holding various blocks of said mat together and said at least one cable loop is not used for lifting said mat during installation when said vacant space receives therein the portion of the vertical object; and said mat is constructed with a first set of one or more rows of said blocks with respective ends of said rows that terminate in base blocks of said vacant space, and wherein said mat is constructed with a second set of one or more rows of said blocks with respective ends of said rows of said second set that terminate in blocks forming respective legs where each said leg forms a respective side of said vacant space, and said cables include cables that are of one strength for holding said blocks together in respective rows that terminate in said base blocks, and said cables include other cables that are stronger than said one strength, and said other cables extend through said rows that terminate in said legs of said vacant space.

14. The mat of erosion control blocks of claim 13, wherein said vacant space is formed inwardly from one of the one end or a side of said mat to accommodate therein at least a portion of a pier.

15. The mat of erosion control blocks of claim 13, wherein said mat is constructed with a width shorter than a length thereof.

16. The mat of erosion control blocks of claim 13, wherein said matrix comprises plural rows of said blocks, and wherein a boundary of said vacant space is U-shaped and bounded by one or more base blocks, and said matrix comprises two legs of blocks for said vacant space where each said leg is parallel to each other, and where the blocks of one said leg are spaced-apart from the blocks of the other said leg.

17. The mat of erosion control blocks of claim 16, wherein said blocks of said plurality each have one or more cable channels formed therethrough, and said mat has a linear edge at one end of said rows, and said cable loops used for lifting said mat extend from the blocks of said linear edge, and further including at least one said cable loop extending from each said leg of said two legs, said cable loops extending from said legs for lifting said mat.

18. The mat of erosion control blocks of claim 13, wherein said mat defines a first mat, the one end of said first mat is linear, and the opposite end of said first mat has said vacant space therein, and further including a second mat with blocks arranged similar to the blocks of said first mat so as to have a linear end and an opposite end having a vacant space, said first mat is located so that said linear end thereof is adjacent to the vertical object, and the vacant space of said second mat at least partially surrounds the vertical object, whereby said first and second mats form an enclosed area so that the vertical object is substantially surrounded by said first and second mats.

19. The mat of erosion control blocks of claim 18, wherein the vertical object comprises a pier, and wherein said enclosed area is bounded by the blocks of said first and second mats that surround the pier.

* * * * *